United States Patent [19]

Oida et al.

[11] 4,232,210

[45] Nov. 4, 1980

[54] OUTPUT POWER CONTROL SYSTEM FOR MICROWAVE OVENS

[75] Inventors: Yoshio Oida, Funabashi; Masayuki Sasaki, Kawasaki; Hidetoshi Semi, Kamakura, all of Japan

[73] Assignee: Tokyo Shibaura Electric Co., Ltd., Japan

[21] Appl. No.: 918,151

[22] Filed: Jun. 22, 1978

[30] Foreign Application Priority Data

Jun. 22, 1977 [JP] Japan ..... 52-73300

[51] Int. Cl.[2] ..... H05B 9/06

[52] U.S. Cl. ..... 219/10.55 C; 219/10.55 B

[58] Field of Search ..... 219/10.55 B, 10.55 C, 219/10.55 R; 340/652, 655

[56] References Cited

U.S. PATENT DOCUMENTS

| | | | |
|---|---|---|---|
| Re. 28,822 | 5/1976 | Fritts | 219/10.55 C |
| 3,715,553 | 2/1973 | Ogawa et al. | 219/10.55 C |
| 3,766,437 | 10/1973 | Fritts | 219/10.55 C |
| 3,816,688 | 6/1974 | Fritts | 219/10.55 C |
| 3,857,067 | 12/1974 | Zanboorie | 219/10.55 C X |
| 4,101,750 | 7/1978 | Doner | 219/10.55 C |
| 4,117,294 | 9/1978 | Appelquist et al. | 219/10.55 C |
| 4,121,079 | 10/1978 | Harmon | 219/10.55 B |

*Primary Examiner*—Arthur T. Grimley

*Attorney, Agent, or Firm*—Finnegan, Henderson, Farabow, Garrett & Dunner

[57] ABSTRACT

An output power control system includes an output power control circuit for producing first and second control signals to control a switch and a semiconductor control element which are inserted between a power source and an oscillating magnetron tube. The output power control circuit includes a main control section and an output control section. The main control section receives a door signal representing the open or closed state of an oven door and an initiating pulse for initiating the operation of the output power control circuit. The same section periodically detects the door signal to produce first and second set signals when the door is closed at the detection, and to produce first and second reset signals when the door is open. The output control section includes a first means and a second means. The first means produces the first and second signals to cause the magnetron tube to oscillate when receiving the first and second set signals while it stops the production of the first and second signals thereby to stop the oscillation of the magnetron tube when receiving the first and second reset signals. The second means immediately stops the oscillation of the magnetron tube by stopping the production of the first and second control signals as the door is opened during the oscillation period of the magnetron tube.

3 Claims, 5 Drawing Figures

OUTPUT POWER CONTROL SYSTEM FOR MICROWAVE OVENS

BACKGROUND OF THE INVENTION

The present invention relates to an output power control system of a microwave oven and, more particularly, an output control system of a microwave oven periodically detecting open or close state of a door of the microwave oven. a magnetron tube for oscillation radiates microwaves in cooking with the door being closed. Radiation of the microwaves ceases when the door is open, even in the cooking, and, when the door is again closed, the radiation restarts.

A recent microwave oven employs an LSI (large scale integrated) circuit to more satisfactorily control the microwave oven, compared to the conventional. In control of such an oven, the control system periodically detects some conditions: the timer is set at a desired time; a start button is pushed; the door is closed. When these conditions are satisfied, the control system causes the magnetron to oscillate. On the other hand, when the conditions are not satisfied, it ceases oscillation of the magnetron. In the control system of the type periodically detecting the open and closed states of the door, when the door is closed at the first detection point, the magnetron tube starts it oscillation and continues it till the next detection point. If the door is manually opened between the first and second detection points, the magnetron continues its oscillation from the door opening point to the succeeding detection point. That is, in this case, the microwaves leak to the exterior and the leakage is dangerious and wasteful of power. Therefore, in such a case, it is necessary to immediately stop the oscillation when the door is opened. One of the control systems for the microwave oven, which periodically detects the open and closed states of the door, is disclosed in the U.S. Patent Application assigned to Tokyo Shibaura Electric Co., Ltd., bearing Ser. No. 887,221, filed on Mar. 16, 1978, by Sadao Zushi and Yoshio Oida, entitled "Microwave Ovens".

Accordingly, an object of the invention is to provide an output power control system for a microwave oven of the type periodically detecting the open and closed states of the door, which can immediately stop oscillation of a magnetron tube when the door is opened in cooking.

SUMMARY OF THE INVENTION

An output power control system for a microwave oven according to the invention is comprised of a switch and a semiconductor element which are connected in series between a power source and a magnetron tube for microwave oscillation and cooperate to control power supply to the magnetron tube and an output power control circuit for producing first and second control signals to control the switch and the semiconductor control element. The output power control circuit comprises: door signal generating means for producing a door signal representing open or closed state of the door of the microwave oven; initiating pulse generating means for producing a pulse to initiating operation of the output power control circuit when the power source is turned on; a main control section receiving the door signal and the initiating pulse, which detects periodically the door signal and, when the door is closed at the detection of the door signal, produces first and second set signals, while, when it is open, produces first and second reset signals; and an output control section coupled with the door signal generating means, the initiating pulse generating means and the main control section, and comprising first mean which, when receiving the first and second set signals, produces the first and second control signals to cause the magnetron tube to oscillate and, when receiving the first and second reset signals, ceases production of the first and second control signals to cease oscillation of the magnetron tube, and second means which instantaneously stops the first and second control signals when the door is opened during the oscillation period of the magnetron tube.

With such a circuit arrangement, there is completely eliminated leakage of microwaves when the door is opened.

DESCRIPTION OF THE PREFERRED EMBODIMENT

Figure 1:
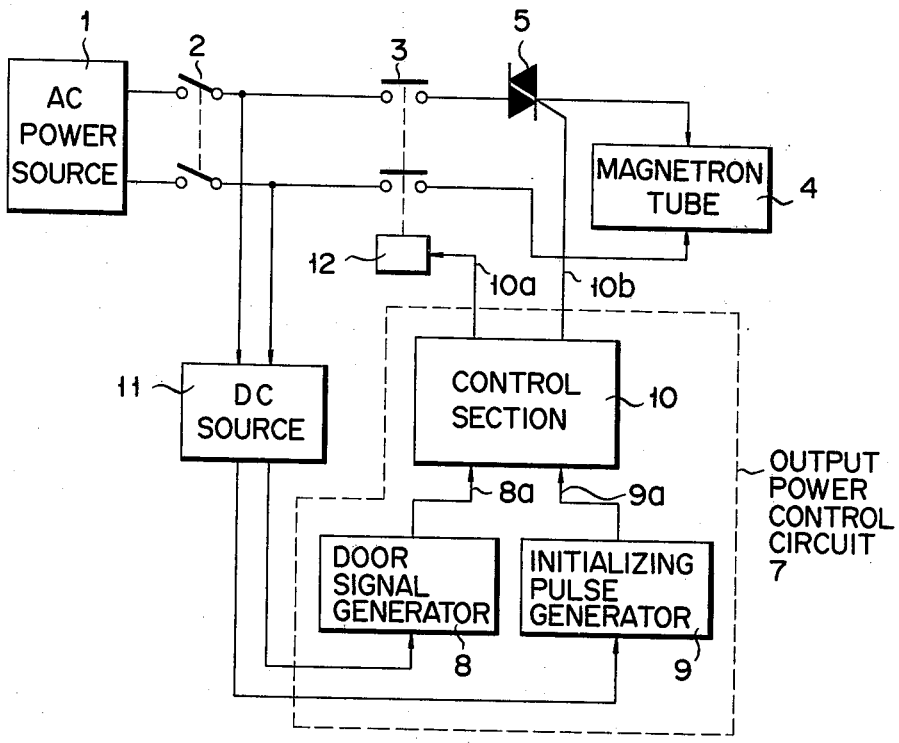
FIG. 1 shows a block diagram of an output power control system for a microwave oven which is an embodiment according to the invention.

For a more complete understanding of the invention, a preferred embodiment according to the invention will be described with reference to FIGS. 1 through 3. In FIG. 1, an AC power source (AC 100 V and 50 Hz) is coupled with a two-pole magnetic switch 3, through a source switch 2. A magnetron tube 4, which produces microwaves, is connected at one of the input terminals to the output terminal of one of the poles of the magnetic switch, through a triac 5. The magnetron tube is connected at the other input terminal directly to the output terminal of the other pole. The magnetron tube 4 produces the microwave within the oven to irradiate foods therein for cooking. The output of the magnetron tube 4 is controlled by the operation, i.e. the close or open, of the magnetic switch 3 and the conduction or non-conduction of the triac 5. An output power control circuit 7 is provided to control the operation of the magnetic switch 3 and the triac 5. The output power control circuit 7 is comprised of a door signal generator 8 for generating a door signal representing open or close state of the door of the oven, an initiating pulse generator 9 for generating an initiating pulse and a control section 10. The initiating pulse sets up an initial state of the control section 10 at the turning-on of the power source 1. A DC source 11 connected to the output side of the source switch 2 is connected at one output to the door signal generator 8 and at the other output to the initiating pulse generator 9. The output of the door signal generator 8, i.e. the door signal 8*a*, and the output signal of the initiating pulse generator 9, i.e. the initiating pulse, are applied to the control section 10. A first control signal 10*a* (MAG) from the control section 10 is applied to a drive circuit 12 for driving the magnetic switch 3. The second control signal 10*b* (PVC) therefrom is delivered to the control electrode of the triac 5. The second control signal 10*b* controls the time durations of "ON" and "OFF" of the triac 5.

Figure 2:
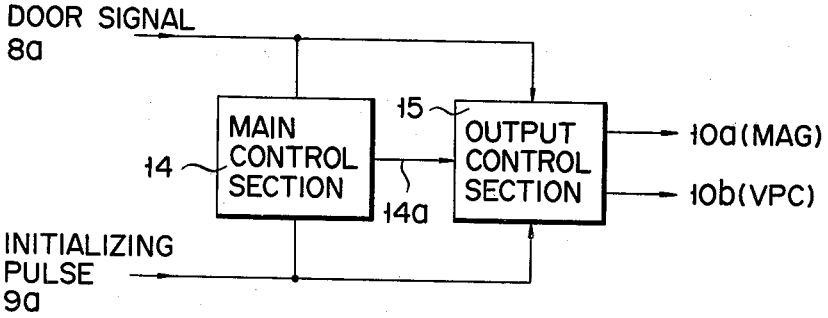
FIG. 2 shows a block diagram of an output power control circuit used in the system in FIG. 1.

The control section 10 includes a main control section 14 and an output control section 15, as shown in FIG. 2. As shown, both sections 14 and 15 receive the door signal 8*a* and the initiating pulse 9*a*. The output signal 14*a* from the main control section 14 is applied to the input of the output control section 15. The output control section delivers the first and second control signals 10*a* (MAG) and 10*b* (VPC).

Figure 3:
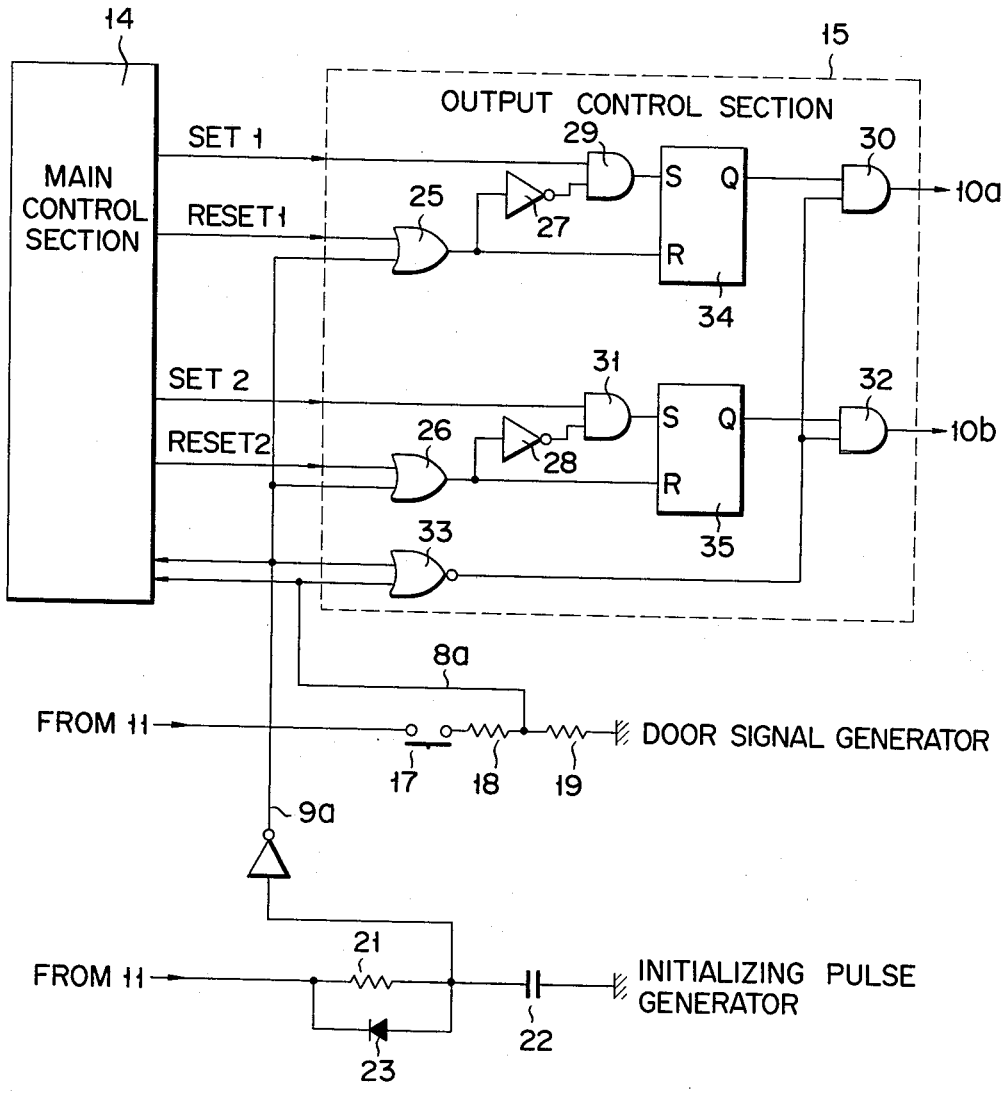
FIG. 3 shows a circuit diagram of an example of the output power system circuit shown in FIG. 2.

The detail of the output power control circuit 7 is illustrated in FIG. 3. The door signal generator 8 is comprised of a door switch 17 connected to the first output of the DC source 11, a resistor 18 connected to the output side of the door switch 17, and another resistor 19 which is connected at one end to the resistor 18 and at the other end to ground. The door signal 8*a* is derived from the connecting point between the resistors 18 and 19. When the door is open, the switch 17 is turned ON and the door signal 8*a* is at "H" level. Conversely, when the door is closed, the switch 18 is turned OFF and the door signal 8*a* is at "L" level. The initiating pulse generator 9 is comprised of a resistor 21 connected to the second output of the DC source 11, a capacitor 22 which is connected at one end to the output terminal of the resistor 21 and at the other end to ground, a diode 23 connected with the polarity as shown across the resistor 21, and an inverter 24 connected to the node between the resistor 21 and the capacitor 22. The initiating pulse 9*a* is derived from the inverter 24. The resistor 21 and the capacitor 22 cooperate to form a time constant circuit. The initiating pulse, i.e. the output signal of the inverter 24, is at "H" level until the capacitor 22 is charged up to a given voltage by the DC source 11. Upon reaching the given voltage, the initiating pulse 9*a* becomes at "L" level, and its level is sustained.

When the source switch 2 (FIG. 1) is turned on, the initiating pulse 9*a* and the door signal 8*a* are applied to the main control section 14. The door signal 8*a* is detected periodically, for example, at the interval of 10 ms. When the close of the door, that is to say, "L" level of the door signal, is detected, the main control section 14 produces the first and second set signals SET1 and SET2. Conversely, when the opening of the door, i.e. "H" level of the door signal, is detected, it produces the first and second reset signals RESET 1 and RESET 2. The output control section 15 is comprised of OR gates 25 and 26, inverters 27 and 28, AND gates 29 to 32, NOR gate 33 and flip-flop circuits 34 and 35. The OR gate 25 is coupled with the first reset signal RESET 1 and the output signal 9*a* of the initiating pulse generator 9. The AND gate 29 is coupled with the first set signal SET 1 and the inverted output of the output of the OR gate 25. The output of the AND gate 29 is applied to the set terminal S of the flip-flop circuit 34. The output of the OR gate 25 is applied to the reset terminal R of the same. The AND gate 30 receives at one of the input terminal the set output Q of the flip-flop circuit 34 and outputs the first control signal 10*a* (MAG). The second reset signal RESET 2 and the output signal 9*a* of the initiating pulse generator are applied to the OR gate 26. The second set signal SET 2 and the inverted output (delivered from the inverter 28) of the OR gate 26 are inputted to the AND gate 31. The flip-flop 35 is connected at the set terminal S to the output of the AND gate 31 and at the reset terminal R to the output of the OR gate 26. The AND gate 32 receives at one of the input terminals the set output Q of the flip-flop circuit 35 and produces the second control signal (VPC). The NOR gate 33 receives the output signal 9*a* of the initiating pulse generator 9 and the door signal 8*a* from the door signal generator 8, and outputs an output signal toward the other inputs of the AND gates 30 and 32.

In operation, food to be cooked is placed in the oven, the door is closed and the source switch 2 is turned on. The door signal 8*a* goes to level "L" and after a given time the initiating pulse 9*a* becomes "L". Accordingly, the NOR circuit 33 is "H" at the output. The main control section 14 detects, at the first detection point, that the door signal 8*a* is "L" (the door is closed) so that the first and second set signals SET 1 and SET 2 are "H" in level. At this time, since the OR gates 25 and 26 are at "L" level, the outputs of the inverters 27 and 28 are at "H" level. Accordingly, the flip-flops 34 and 35 are set to produce the set outputs Q, respectively. As a result, the AND gates 30 and 32 produce the first and second control signals 10*a* (MAG) and 10*b* (VPC). Therefore, the magnetron tube 4 oscillates and its output signal is controlled by the signals SET 1, SET 2, RESET 1 and RESET 2. If the door is closed at the second detection point (as recalled, the interval between the first and second detection points is about 10 ms) in the main control section 14, the output of the magnetron tube 4 is controlled by the first and second control signals.

When the door is open within the interval between the first and second detection points for the door signal 8*a*, the magnetron tube continues its oscillation till the second detection point and thus the microwaves continuously leaks from the oven. In the circuit shown in FIG. 3, however, as soon as the door is open, the door signal 8*a* becomes "H", and therefore the output of the NOR gate 33 becomes "L". At this time, even if the set outputs Q at "H" level from the flip-flops are produced, the outputs 10*a* (MAG) and 10*b* (TVC) of the AND gates 30 and 32 become "L", the oscillation of the magnetron tube 4 ceases immediately after the door is opened.

In case where the door is opened and closed again between the first and second detection points (in this case, it seems that it is impossible to manually open and close the door within such a short time), generation of the first and second signals 10*a* and 10*b* may instantaneously be stopped at the opening of the door, as previously stated. Therefore, the leakage of microwaves can surely be prevented.

There is a case where it is undesirable to produce the first and second control signals 10*a* and 10*b* at the turning-on of the power source 1. In the circuitry of the invention, however, the operation of the time constant circuit of the initiating pulse generator 9 sustains the level of the initiating pulse 9*a* at "H" until a given time lapses after the power source is turned on. Therefore, the output of the NOR gate 33 continues its level at "L" until the given time lapses. As a result, even if the set outputs Q of the flip-flop circuits 34 and 35 are at "H", the first and second control signals 10*a* and 10*b* are not produced. The given time lapses and the initiating pulse 9*a* becomes "L" in level so that the output of the NOR gate 33 becomes "H". The main control section 14 detects "L" of the door signal 8*a* so that the first and second control signals 10*a* and 10*b* are outputted following the outputting of the first and second set signals SET 1 and SET 2.

Figure 4:
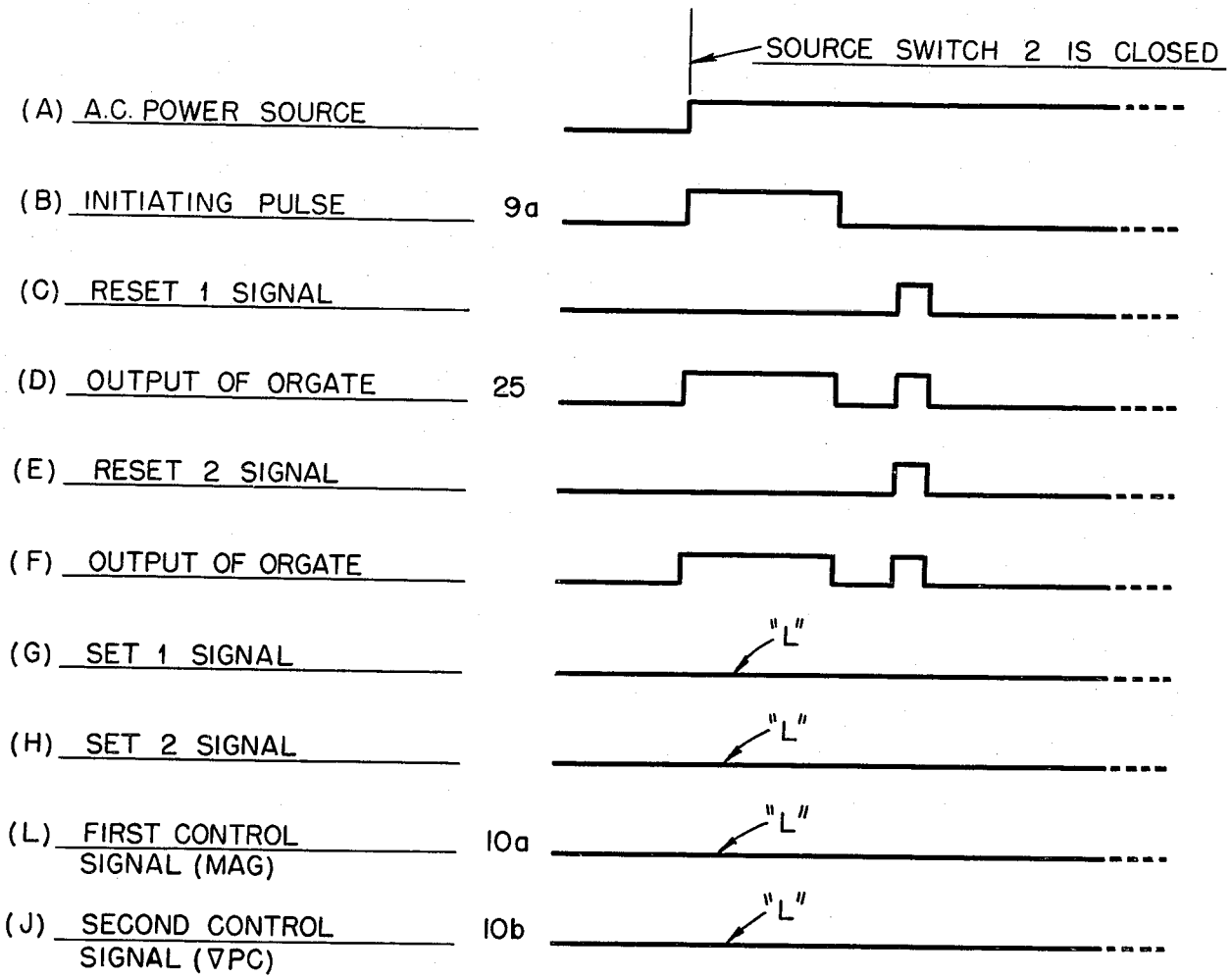
FIG. 4 shows pulse timing charts at various points in the circuits of FIG. 1 and FIG. 3 when power is applied.
Figure 5:
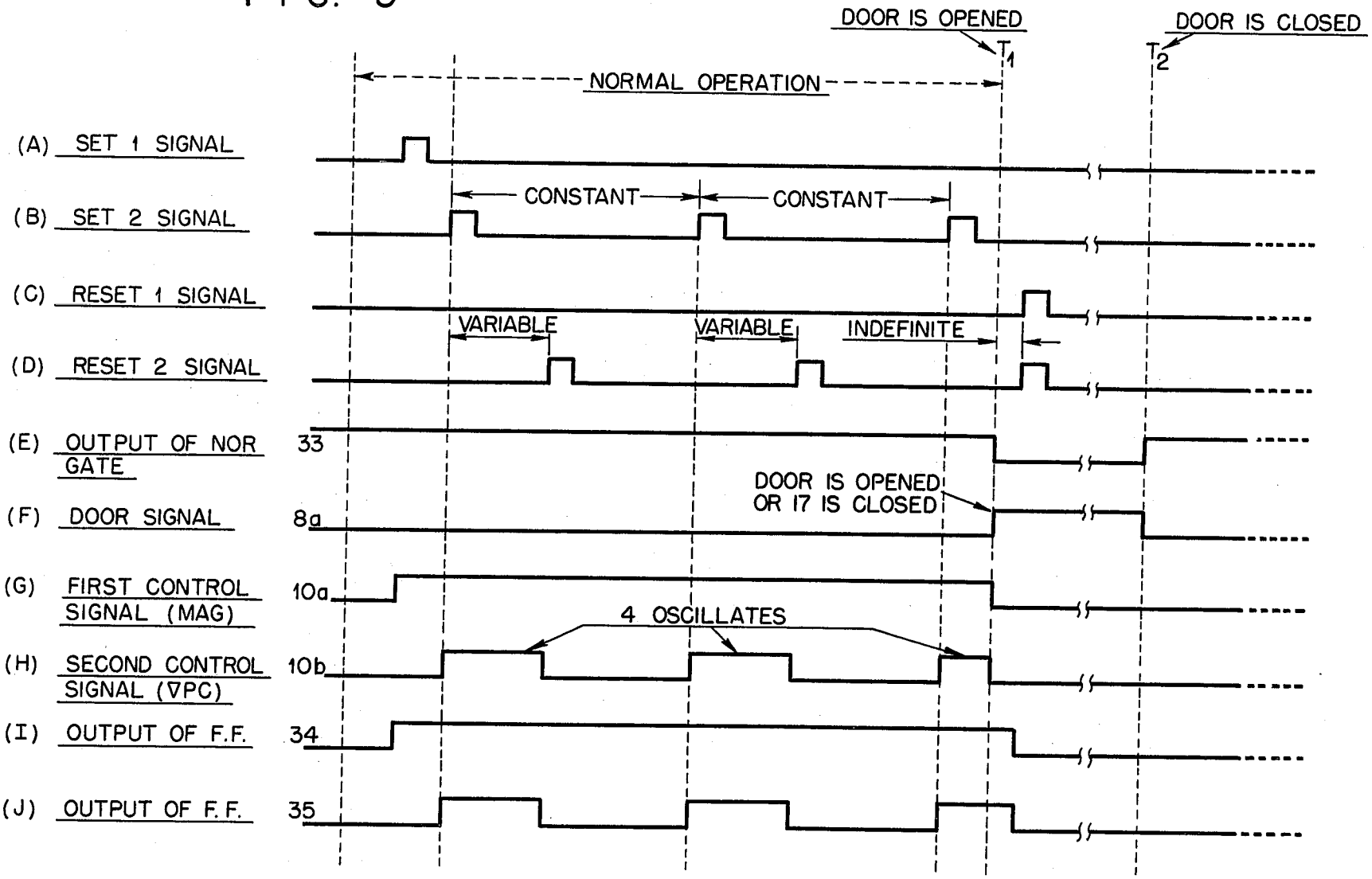
FIG. 5, shows pulse timing charts at various points in the circuit of FIG. 3 during a normal operation of a microwave oven and at door opening and door reclosing of the oven.

As shown in FIG. 4, when source switch 2 is turned on, initiating pulse 9*a*, signal RESET 1, signal RESET 2 and outputs of OR gates 25 and 26 are produced. However, signals SET 1 and SET 2 remain at L level. Therefore, first and second control signals are kept at the L level. This means that the magnetron tube 4 is not energized.

As shown in FIG. 4, before time $T_1$ a microwave oven is operated in a normal state. While the microwave oven is in the normal state, signals SET 2 and RESET 2 are produced at predetermined intervals. The period between signals SET 2 and RESET 2 is properly set. The output of flip-flop circuit 34 is maintained at the "H" level, while the flip-flop circuit 35 is set and reset periodically according to the predetermined intervals. During the "H" level period of the second control signal 10*b*, the magnetron tube 4 oscillates. At time $T_1$ the door is opened, and the output of the NOR gate 33 goes to the "L" level, while the door signal 8*a* goes to the "H" level. The signals RESET 1 and RESET 2 are produced after an indefinite time period depending upon detection of the door signal. The output of flip-flop circuit 34 is terminated when signals RESET 1 and RESET 2 are produced. At time $T_2$, the door is closed, and the output of the NOR gate 33 goes to the "H" level, while the door signal 8*a* goes to the "L" level. However, signals SET 2 and RESET 1 are not produced unless the microwave oven is started again.

When the output levels of the flip-flop circuits 34 and 35 are not fixed at eithter "H" or "L" at the turning-on of the power source, the first and second set signals SET 1 and SET 2 are produced after the given time, as mentioned above. Further, the first and second control outputs are not produced until the outputs Q of the flip-flops 34 and 35 are set at "H" level. As a consequence, not trouble occurs in such a case.

As seen from the drawing, the control circuit shown in FIG. 3 is well adaptable for the integrated circuit fabrication. Accordingly, it may readily improve the reliability, to make its size small and to make its weight light.

What we claim is:

1. An output power control system for a microwave oven, comprising:

an AC power source;

a magnetron tube for microwave oscillation;

switch means and a semiconductor element connected in series between said AC power source and said magnetron tube for controlling the power to said magnetron tube;

a DC power source coupled to said AC power source; and an output power control circuit coupled to said DC power source and supplying first and second control signals to said switch means and said semiconductor element, respectively;

said output power control circuit comprising:

a door signal generating means coupled to said DC power source for producing door signals representing the open and closed state of a door of said microwave oven;

an initiating pulse generating means coupled to said DC power source for producing a pulse to initiate the operation of said output power control circuit when said AC power source is turned on;

a main control section receiving said door signal and said initiating pulse for periodically detecting said door signals, said main control section producing first and second set signals when said door is closed at said periodic detection and producing first and second reset signals when said door is opened at said periodic detection; and an output control section coupled to said door signal generating means, said initiating pulse generating means, said main control section, said switch means, and said semiconductor element, said output control section comprising first means which produces said first and second control signals for causing said magnetron tube to oscillate when receiving said first and second set signals and which stops producing said first and second control signals when receiving said first and second reset signals, and second means which instantaneously stops said first and second control signals when said door is opened during the oscillation period of said magnetron tube.

2. An output power control system for a microwave oven according to claim 1, wherein said door signal generating means produces a door signal which is at a first level when the door is closed and is at a second level when the door is open, and said initiating pulse generating means includes a time constant circuit for producing an output signal which is at the second level during a given time after said power source is turned on and is at the first level after a given time elapses.

3. An output power control system for a microwave oven according to claim 1, wherein said output control section comprises: a first OR gate receiving said first reset signal and said initiating pulse; a first AND gate receiving said first set signal and an inverted output signal of the output of said first OR gate; a first flip-flop circuit which is set by the output of said first AND gate to produce a set output and is reset by the output of said first OR gate; a second AND gate which receives at one of the input terminals the set output of said first flip-flop and produces said first control signal; a second OR gate receiving said second reset signal and said initiating pulse; a third AND gate receiving said second set signal and an inverted output of the output of said second OR gate; a second flip-flop circuit which is set by the set output of said third AND gate and is reset by the output of said second OR gate; a fourth AND gate which receives at one input the set output of said second flip-flop circuit and produces said second control signal; and an NOR gate receiving said initiating pulse and said door signal; wherein the output of said NOR gate is applied to the other inputs of said second and fourth AND gates and the generations of said first and second control signals are stopped substantially at the same time as said door is opened.

* * * * *